US008192303B2

(12) United States Patent
Ban

(10) Patent No.: US 8,192,303 B2
(45) Date of Patent: Jun. 5, 2012

(54) GOLF CLUB HEAD

(75) Inventor: Wataru Ban, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 208 days.

(21) Appl. No.: 12/496,087

(22) Filed: Jul. 1, 2009

(65) Prior Publication Data

US 2010/0075774 A1 Mar. 25, 2010

(30) Foreign Application Priority Data

Sep. 19, 2008 (JP) ..... 2008-241654

(51) Int. Cl.
*A63B 53/04* (2006.01)
*A63B 53/06* (2006.01)

(52) U.S. Cl. ..... 473/335; 473/345

(58) Field of Classification Search ..... 473/324–350
See application file for complete search history.

(56) References Cited

U.S. PATENT DOCUMENTS

| | | | | | |
|---|---|---|---|---|---|
| 1,096,359 | A | * | 5/1914 | Dwight | 473/337 |
| 1,133,129 | A | * | 3/1915 | Govan | 473/337 |
| 1,167,387 | A | * | 1/1916 | Daniel | 473/337 |
| 1,518,316 | A | * | 12/1924 | Ellingham | 473/337 |
| 1,840,924 | A | * | 1/1932 | Tucker | 473/337 |
| 2,056,335 | A | * | 10/1936 | Wettlaufer | 473/245 |
| 2,750,194 | A | * | 6/1956 | Clark | 473/337 |
| 3,064,980 | A | * | 11/1962 | Steiner | 473/335 |
| 3,606,327 | A | * | 9/1971 | Gorman | 473/297 |
| 4,052,075 | A | * | 10/1977 | Daly | 473/338 |
| 4,325,553 | A | * | 4/1982 | Taylor | 473/337 |
| 4,754,976 | A | * | 7/1988 | Pelz | 473/340 |
| 4,754,977 | A | | 7/1988 | Sahm | |
| 4,869,507 | A | | 9/1989 | Sahm | |
| 5,046,740 | A | * | 9/1991 | D'Eath | 473/255 |
| 5,121,922 | A | * | 6/1992 | Harsh, Sr. | 473/251 |
| 5,344,151 | A | * | 9/1994 | Anderson et al. | 473/337 |
| 5,385,348 | A | | 1/1995 | Wargo | |
| 5,518,243 | A | | 5/1996 | Redman | |
| 6,277,032 | B1 | * | 8/2001 | Smith | 473/336 |
| 6,749,523 | B1 | | 6/2004 | Forzano | |
| 6,773,360 | B2 | * | 8/2004 | Willett et al. | 473/334 |
| 6,991,558 | B2 | * | 1/2006 | Beach et al. | 473/324 |
| 7,147,573 | B2 | | 12/2006 | DiMarco | |
| 7,156,752 | B1 | * | 1/2007 | Bennett | 473/334 |
| 7,166,041 | B2 | * | 1/2007 | Evans | 473/334 |
| 7,198,575 | B2 | * | 4/2007 | Beach et al. | 473/324 |
| 7,223,180 | B2 | | 5/2007 | Willett et al. | |
| 7,351,161 | B2 | * | 4/2008 | Beach | 473/334 |
| 7,374,497 | B2 | * | 5/2008 | Brown | 473/251 |
| 7,410,425 | B2 | | 8/2008 | Willett et al. | |

(Continued)

FOREIGN PATENT DOCUMENTS

JP 7-15067 U 3/1995

(Continued)

*Primary Examiner* — Alvin Hunter
(74) *Attorney, Agent, or Firm* — Sughrue Mion, PLLC

(57) ABSTRACT

A golf club head of this invention includes a head body, a weight member attached to the head body, and a fixing unit to fix the weight member at any one of a plurality of attachment positions of the head body. The plurality of attachment positions are located on a straight line included in a plane. The plane includes the center-of-gravity position of the head body without the weight member attached thereto and is perpendicular to the toe-and-heel direction of the head body.

2 Claims, 5 Drawing Sheets

U.S. PATENT DOCUMENTS

| | | | | |
|---|---|---|---|---|
| 7,410,426 | B2 | 8/2008 | Willett et al. | |
| 7,452,286 | B2 * | 11/2008 | Lin et al. | 473/334 |
| 7,566,276 | B2 * | 7/2009 | Billings | 473/251 |
| 7,611,424 | B2 * | 11/2009 | Nagai et al. | 473/334 |
| 7,611,425 | B2 * | 11/2009 | Yeh | 473/337 |
| 7,625,298 | B2 * | 12/2009 | Bennett | 473/334 |
| 7,637,823 | B2 * | 12/2009 | Shimazaki et al. | 473/332 |
| 7,775,905 | B2 * | 8/2010 | Beach et al. | 473/334 |
| 7,824,280 | B2 * | 11/2010 | Yokota | 473/334 |
| 2006/0122004 | A1 * | 6/2006 | Chen et al. | 473/335 |

FOREIGN PATENT DOCUMENTS

| | | | | |
|---|---|---|---|---|
| JP | 09000667 | A | * | 1/1997 |
| JP | 9028844 | A | | 2/1997 |
| JP | 10127836 | A | * | 5/1998 |
| JP | 10263116 | A | * | 10/1998 |
| JP | 11-009742 | A | | 1/1999 |
| JP | 11009742 | A | * | 1/1999 |
| JP | 2001-137400 | A | | 5/2001 |
| JP | 2001149514 | A | * | 6/2001 |
| JP | 2004081241 | A | * | 3/2004 |
| JP | 2006-102235 | A | | 4/2006 |
| JP | 2006198251 | A | * | 8/2006 |
| JP | 2006198385 | A | * | 8/2006 |
| JP | 3127234 | U | | 11/2006 |
| JP | 2006320493 | A | * | 11/2006 |
| JP | 2007136068 | A | * | 6/2007 |
| JP | 2007-222257 | A | | 9/2007 |

* cited by examiner

GOLF CLUB HEAD

BACKGROUND OF THE INVENTION

1. Field of the Invention

The present invention relates to a golf club head.

2. Description of the Related Art

There have been proposed golf club heads in which golfers can change the position of a weight member attached to the golf club head in accordance with their preference. Japanese Patent Laid-Open Nos. 2001-137400, 2006-102235, and 2007-222257 disclose putter heads in which the position of the weight member can be changed. Japanese Utility Model Laid-Open No. 7-15067, Japanese Patent Laid-Open No. 11-9742, and Japanese Utility Model Registration No. 3127234 disclose wood type golf club heads in which the position of the weight member can be changed.

When the position of the weight member is changed, the center-of-gravity position of the golf club head changes. In a wood type or utility type (hybrid type) golf club head, as the center-of-gravity position changes, the height or lateral directionality of flight of a hit ball changes. Users can change the position of the weight member to obtain their preferred ball flight.

However, some golfers may want to adjust only the height of ball flight. If both the height and lateral directionality of flight of the hit ball change in accordance with a change in position of the weight member, it is not possible to satisfy such users' needs. In addition, if a swing feel of a golf club largely changes in accordance with a change in position of the weight member, players, particularly those that are advanced, may feel a sense of discomfort. Therefore, it is preferable that a swing feel of a golf club does not change as much as possible in accordance with a change in position of the weight member.

SUMMARY OF THE INVENTION

It is an object of the present invention to provide a golf club head in which the position of a weight member can be changed, a change in lateral directionality of flight of a hit ball and a change in swing feel of a golf club are reduced, and the height of flight of the hit ball is adjustable.

According to the present invention, there is provided a golf club head comprising a head body, a weight member attached to the head body, and fixing means for fixing the weight member at any one of a plurality of attachment positions of the head body, wherein the plurality of attachment positions are located on a straight line included in a plane, and the plane includes a center-of-gravity position of the head body without the weight member attached thereto and is perpendicular to a toe-and-heel direction of the head body.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

<First Embodiment>

Figure 1:
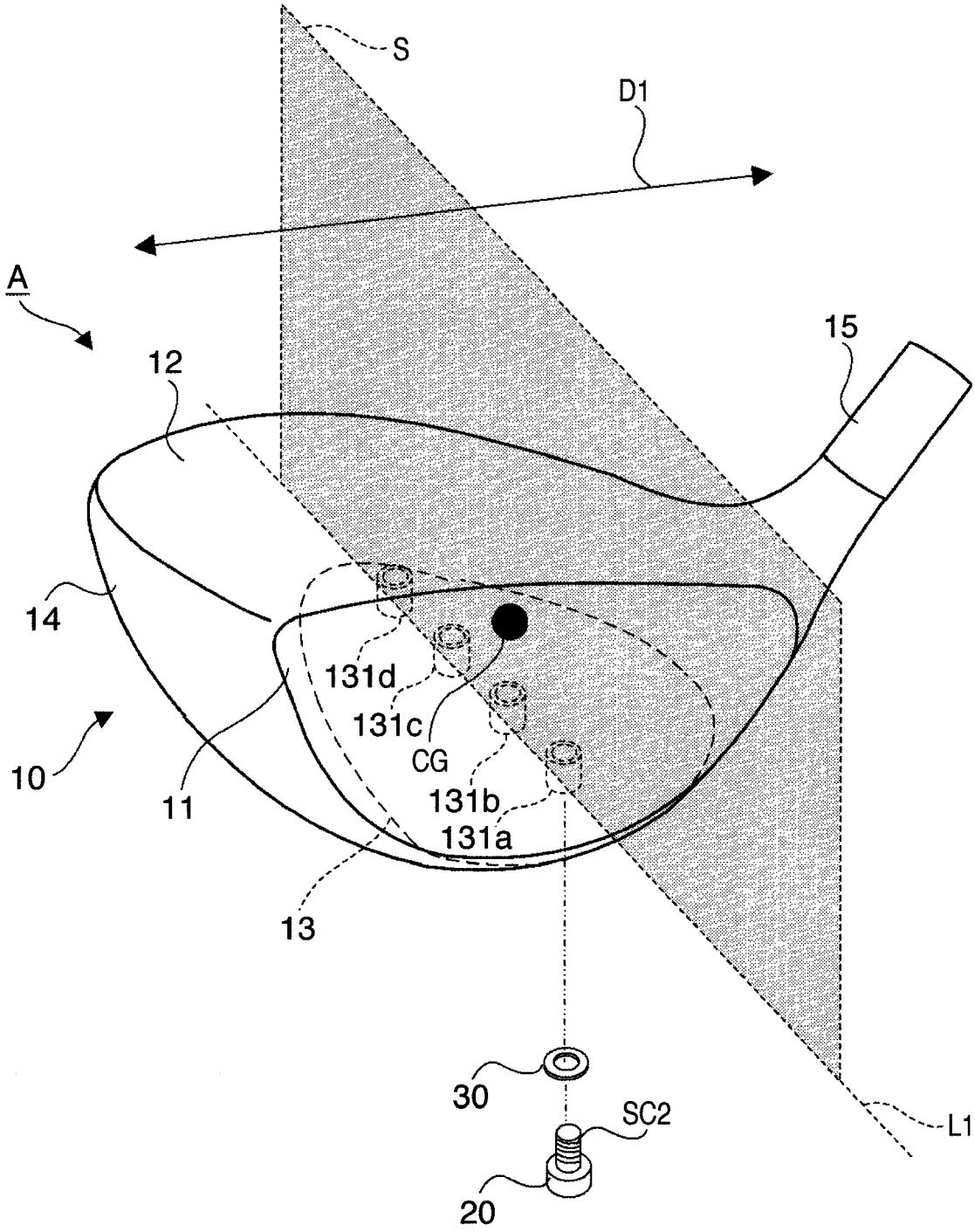
FIG. 1 is a perspective view of a golf club head A according to one embodiment of the present invention.
Figure 2:
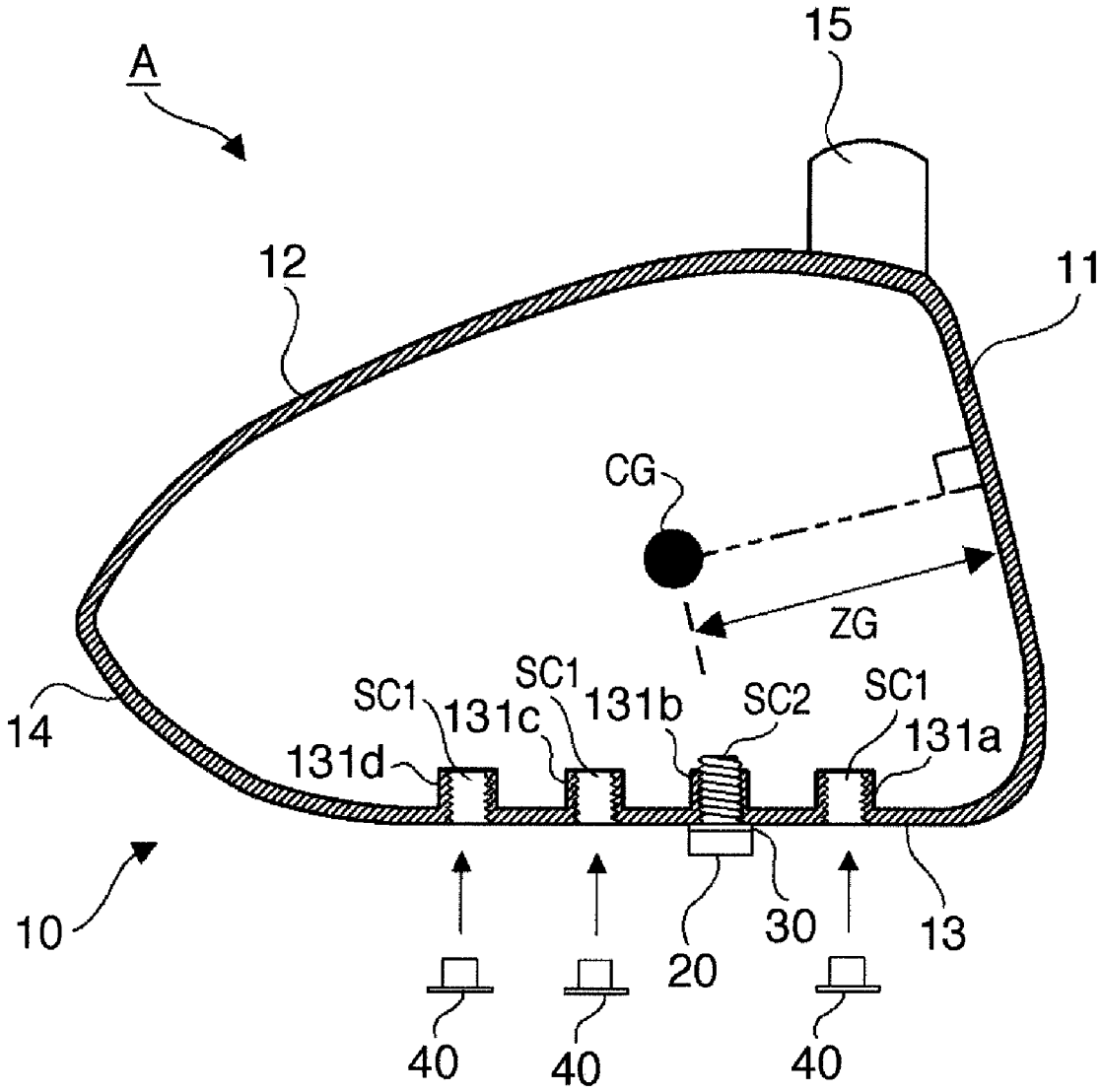
FIG. 2 is a sectional view of the golf club head A taken along a plane S in FIG. 1.

FIG. 1 is a perspective view of a golf club head A, and particularly of a sole portion 13 according to one embodiment of the present invention. FIG. 2 is a sectional view of the golf club head A taken along a plane S in FIG. 1 when seen from the toe side of the golf club head A.

The golf club head A includes a head body 10 and a weight member 20. The head body 10 is a hollow body, and its circumferential wall constitutes a face portion 11 forming a golf ball hitting surface, a crown portion 12 forming the top surface of the golf club head A, the sole portion 13 forming the bottom surface of the golf club head A, and a side portion 14 forming the toe-side, heel-side, and back-side side surfaces of the golf club head A. A hosel portion 15 to which a shaft is to be attached is also provided in the head body 10.

Although the golf club head A is a golf club head for a driver, the present invention is applicable to wood type golf club heads including a fairway wood and the like other than a driver, utility type (hybrid type) golf club heads, and other hollow golf club heads. The head body 10 is a hollow body in this embodiment, but it may be solid.

The head body 10 can be assembled by joining a plurality of parts. For example, the face portion 11 and the other part can be formed as different members and joined to form the head body 10. Also, the face portion 11, the sole portion 13, and the other part can be formed as different members and joined to form the head body 10. The head body 10 can be made from e.g., a metal material including a titanium metal material. The head body 10 can be made from different materials. For example, it can be made from a metal material and a carbon fiber material.

A plurality of attachment portions 131*a* to 131*d*, which define the attachment positions of the weight member 20, are formed in the sole portion 13. Although four attachment portions 131*a* to 131*d* are provided in this embodiment, the number of the attachment portions is not limited to four. The user of the golf club head A can attach the weight member 20 to any one of the attachment portions 131*a* to 131*d*.

Each of the attachment portions 131*a* to 131*d* forms a tube having a female screw hole SC1. The weight member 20 has an axial male screw portion SC2. The weight member 20 can be fixed to the head body 10 by threadably engaging the female screw hole SC1 and male screw portion SC2 to each other.

A washer 30 is a resin member inserted between the weight member 20 and the sole portion 13. The washer 30 serves to prevent loose threadable engagement between the female screw hole SC1 and male screw portion SC2, thereby preventing the weight member 20 fixed once from falling easily. The washer 30 may be integrally provided in the weight member 20. For example, the washer 30 may be fixed to the weight member 20 in advance. Also, the surface of the weight member 20 may be covered with a resin material.

As shown in FIG. 2, of the attachment portions 131*a* to 131*d*, the female screw holes SC1 to which the weight member 20 is not attached can be closed by attaching caps 40. With this arrangement, it is possible to prevent dust and the like from entering the head body 10 through the female screw holes SC1. The cap 40 is made from, e.g., a resin material, and detachably fitted in the female screw hole SC1. In order to prevent dust and the like from entering the head body 10 through the female screw holes SC1, instead of using the caps 40, the female screw holes SC1 may be closed at their upper ends.

The weight member 20 can be made from, e.g., a metal material. As such a metal material, for example, tungsten, a tungsten alloy, aluminum, an aluminum alloy, magnesium, and a magnesium alloy are available. The weight member 20 may be made by, e.g., mixing a metal powder with a viscoelastic material. In this case, the vibration dampening effect of the golf club head A at impact can improve. As such a viscoelastic material, for example, NBR (acrylonitrile-butadiene rubber) is available.

Figure 3A:
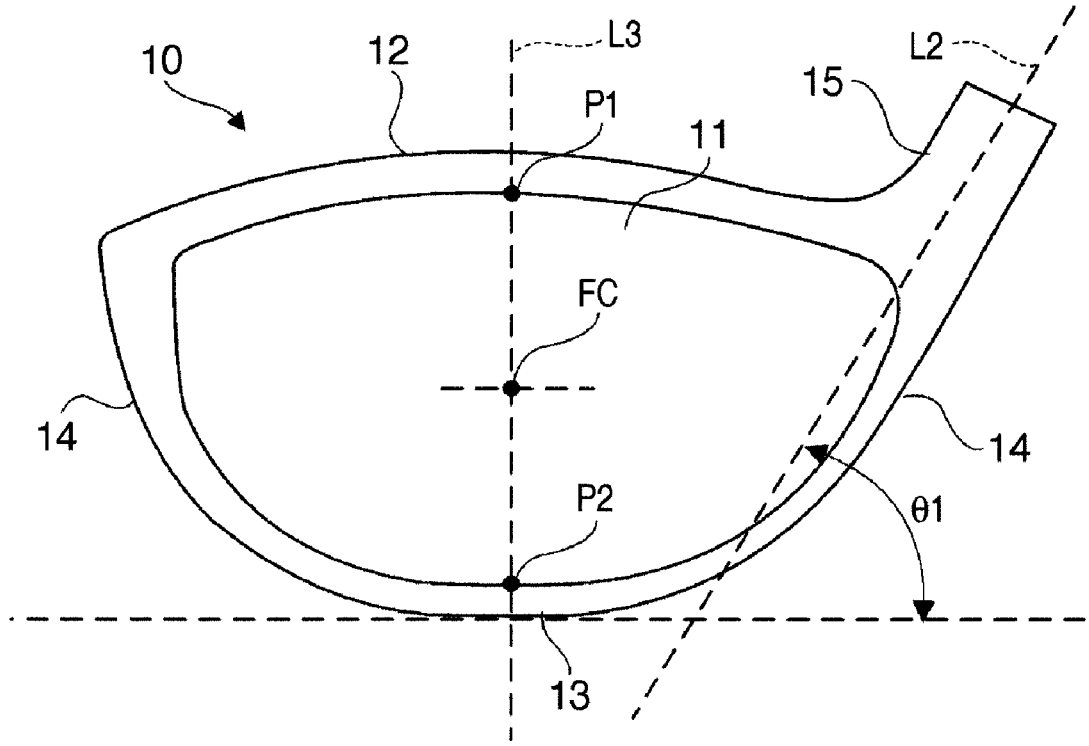
FIGS. 3A and 3B are views for explaining a face center FC.
Figure 3B:
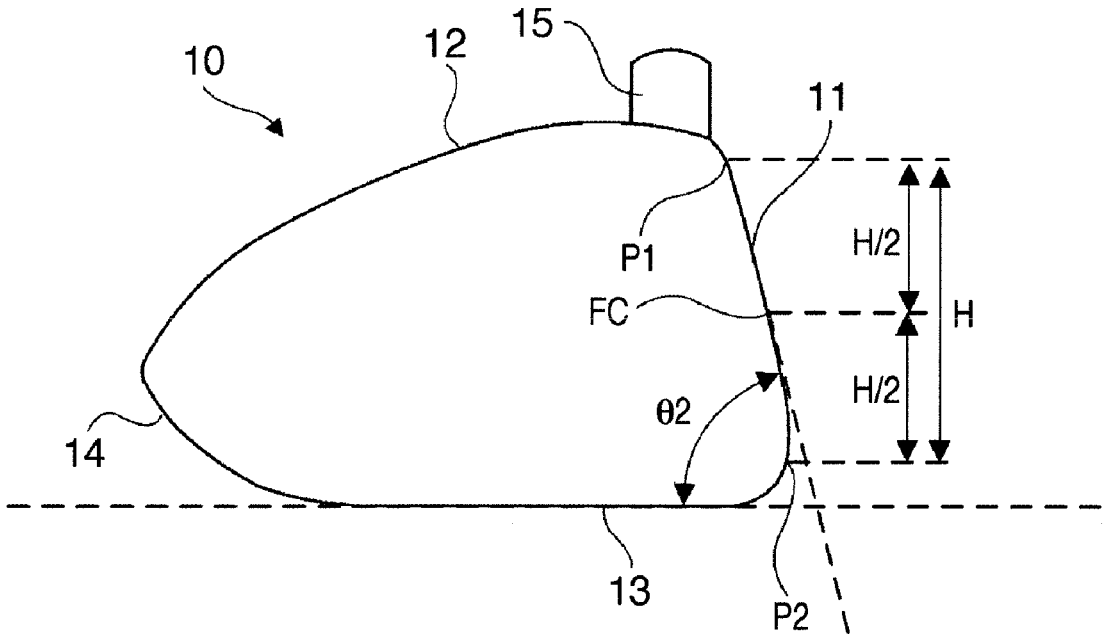

The positions of the attachment portions 131*a* to 131*d* will be described next. In FIGS. 1 and 2, a center-of-gravity position CG represents the center-of-gravity position of the head body 10 without the weight member 20 attached thereto. In FIG. 2, a center-of-gravity depth ZG indicates the length of a perpendicular line from the center-of-gravity position CG to the face portion 11, and represents the center-of-gravity depth when the weight member 20 is not attached. Note that when the face portion 11 does not form a flat surface but forms an arcuate surface, a virtual plane touching the face center is used as a reference. FIGS. 3A and 3B are views for explaining a face center FC.

In FIG. 3A, an angle θ1 indicates a lie angle, which is an angle formed by the ground surface and an axis L2 of a shaft to be attached to the hosel portion 15. In FIG. 3B, an angle θ2 indicates a loft angle, which is an angle formed by the face portion 11 and the ground surface. In FIG. 3A, a line L3 is a line which passes the center line in the toe-and-heel direction of the portion touching the ground surface, as shown in FIG. 3A, when the head body 10 touches the ground surface with its defined lie angle and loft angle. Positions P1 and P2 indicate the upper end and lower end, respectively, of the face portion 11 at which the face portion 11 intersects the line L3. The position at which a height difference H between the positions P1 and P2 is halved is defined as the face center FC.

Referring back to FIGS. 1 and 2, the positions of the attachment portions 131*a* to 131*d* will be further described. In FIG. 1, the plane S is a virtual plane that includes the center-of-gravity position CG of the head body 10 and is perpendicular to a toe-and-heel direction D1 of the head body 10. In this embodiment, the toe-and-heel direction D1 is a direction parallel to the face portion 11. When the face portion 11 does not form a flat surface but forms an arcuate surface, the virtual plane that touches the face center FC described with reference to FIGS. 3A and 3B is used as a reference. The attachment portions 131*a* to 131*d* are located on a straight line L1 included in the plane S.

The effect obtained by arranging the attachment portions 131*a* to 131*d* on the straight line L1 will be described next. When the weight member 20 is fixed to any one of the attachment portions 131*a* to 131*d*, the center-of-gravity position and center-of-gravity depth of the golf club head A change accordingly.

For example, when the weight member 20 is attached to the attachment portion 131*a*, the center-of-gravity position of the golf club head A moves toward the face portion 11 side from the center-of-gravity position CG of the head body 10, and the center-of-gravity depth of the golf club head A becomes smaller than the center-of-gravity depth ZG of the head body 10. When the center-of-gravity depth becomes smaller, the flight of hit ball becomes relatively low. On the other hand, when the weight member 20 is attached to the attachment portion 131*d*, the center-of-gravity position of the golf club head A moves toward the back side from the center-of-gravity position CG of the head body 10, and the center-of-gravity depth of the golf club head A becomes larger than the center-of-gravity depth ZG of the head body 10. When the center-of-gravity depth becomes larger, the flight of hit ball becomes relatively high.

As described above, in this embodiment, it is possible to adjust the height of flight of a hit ball by selecting the attachment portions 131*a* to 131*d* used to fix the weight member 20. It is preferable that the height difference between the flights of hit ball becomes as large as possible by selecting the attachment portions 131*a* to 131*d* used to fix the weight member 20. Therefore, the change amount of center-of-gravity depth of the golf club head A caused by the difference between the attachment portions 131*a* to 131*d* used to fix the weight member 20, for example, the difference in center-of-gravity depth between a case in which the weight member 20 is attached to the attachment portion 131*a* and a case in which the weight member 20 is attached to the attachment portion 131*d*, is preferably 3 mm or more.

Since the attachment portions 131*a* to 131*d* are located on the straight line L1 that is perpendicular to the toe-and-heel direction of the head body 10, regardless of the attachment portions 131*a* to 131*d* used to fix the weight member 20, the center-of-gravity position of the golf club head A hardly moves in the toe-and-heel direction. Therefore, the lateral directionality of flight of a hit ball hardly changes, and hence it is possible to adjust only the height of flight of a hit ball.

Advanced players have a sharp sense for golf clubs. Accordingly, the farther the attachment position of the weight member 20 is from the center-of-gravity position CG of the head body 10, the more readily the advanced players may recognize the presence of the weight member 20 and feel a sense of discomfort for the swing feel of a golf club. Particularly, the farther the attachment position of the weight member 20 is from the center-of-gravity position CG of the head body 10 in the toe-and-heel direction, the more easily the presence of the weight member 20 is recognized. This is because the face rotation characteristic of the golf club head A largely changes. On the other hand, when the attachment position of the weight member 20 is spaced apart from the center-of-gravity position CG of the head body 10 in the face-and-back direction, the face rotation characteristic of the golf club head A does not change much, and the presence of the weight member 20 is less pronounced.

In this embodiment, the attachment portions 131*a* to 131*d* are located on the straight line L1, that is perpendicular to the toe-and-heel direction of the head body 10 and included in the plane S including the center-of-gravity position CG of the head body 10, the swing feel of a golf club becomes smaller, and therefore it is possible to reduce discomfort felt by advanced players.

Note that although the one weight member 20 is used in this embodiment, one of a plurality of weight members 20 having different weights may be selectively fixed to the head body 10. With this arrangement, it becomes possible to widen the selection range of center-of-gravity position and center-of-gravity depth of the golf club head A and to increase their choices as well. In this case, the two or more weight members 20 may simultaneously be fixed to the head body 10.

<Second Embodiment>

Figure 4:
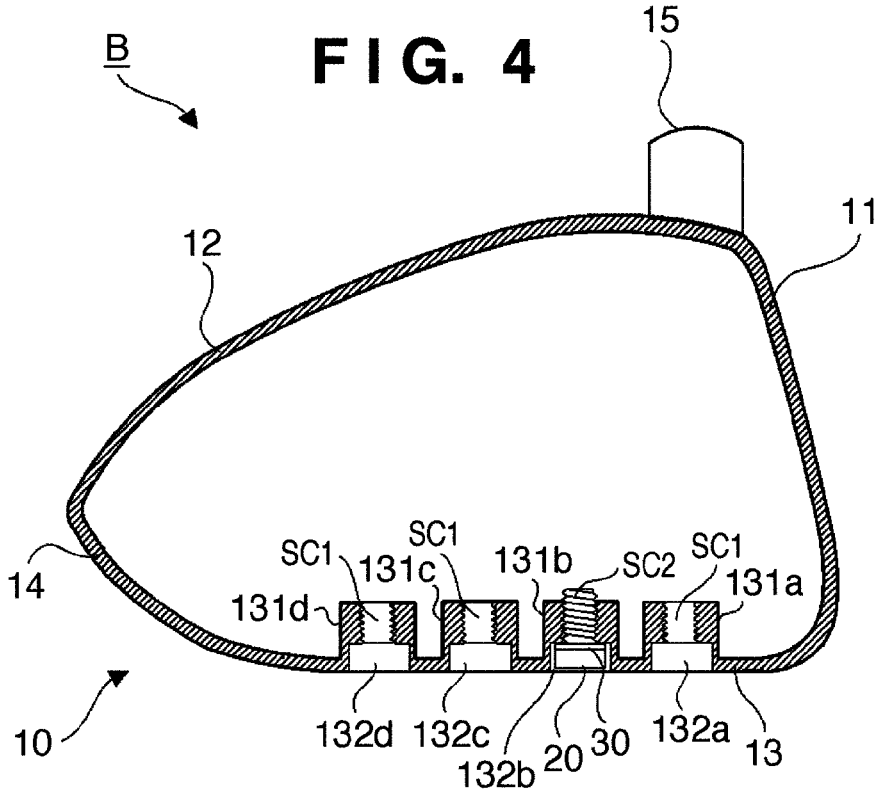
FIG. 4 is a sectional view of a golf club head B according to another embodiment of the present invention.

FIG. 4 is a sectional view of a golf club head B according to another embodiment of the present invention, taken along the same plane as in the sectional view of FIG. 2. The same components as in the golf club head A of the above-described first embodiment are denoted by the same reference numerals below, and a description thereof will not be repeated. Only components different from those of the golf club head A will be described.

In this embodiment, recesses 132*a* to 132d to accommodate a weight member 20 are provided in attachment portions 131*a* to 131*d*, respectively. The depth of each of the recesses 132*a* to 132*d* is set such that the lowest portion of the weight member 20 fixed to a head body 10 is positioned above the lowest portion of a sole portion 13.

With this arrangement, as shown in FIG. 4, the weight member 20 does not project from the sole portion 13. Accordingly, it is possible to prevent the weight member 20 from catching the ground upon hitting a ball.

<Third Embodiment>

Figure 5:
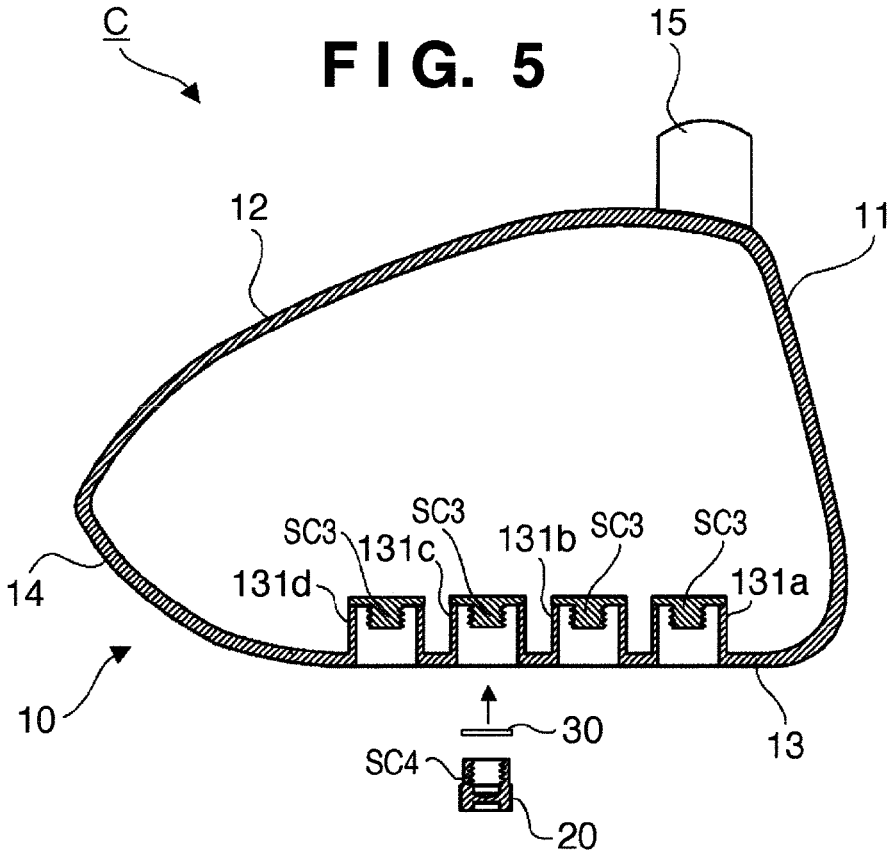
FIG. 5 is a sectional view of a golf club head C according to still another embodiment of the present invention.

FIG. 5 is a sectional view of a golf club head C according to still another embodiment of the present invention, taken along the same plane as in the sectional view of FIG. 2. The same components as in the golf club head A of the above-described first embodiment are denoted by the same reference numerals below, and a description thereof will not be repeated. Only components different from those of the golf club head A will be described.

In this embodiment, axial male screw portions SC3 are provided in respective attachment portions 131*a* to 131*d*, and a female screw hole SC4 which threadably engages with the male screw portion SC3 is provided in a weight member 20. Each of the attachment portions 131*a* to 131*d* also has an internal space to accommodate the weight member 20, so the weight member 20 does not project from a sole portion 13, as in the above-described second embodiment.

In this manner, the screw portion on the sole portion 13 side and that on the weight member 20 side may be a male screw and female screw, respectively, and vice versa.

<Fourth Embodiment>

In the above-described first to third embodiments, the weight member 20 can be fixed at a plurality of positions on the straight line L1 spaced apart from each other. However, the weight member 20 may be fixable at a give position on the straight line L1. With this arrangement, it is possible to more finely adjust the center-of-gravity position and center-of-gravity weight of the golf club head.

Figure 6A:
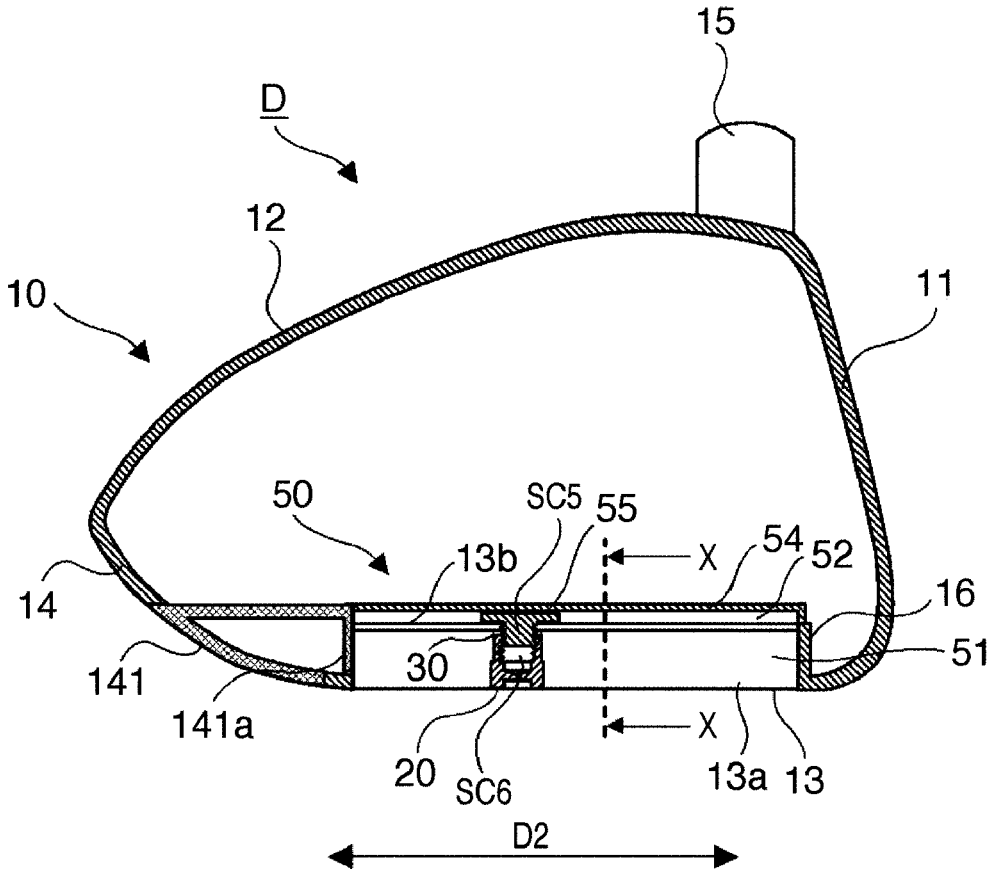
FIG. 6A is a sectional view of a golf club head D according to still another embodiment of the present invention.
Figure 6B:
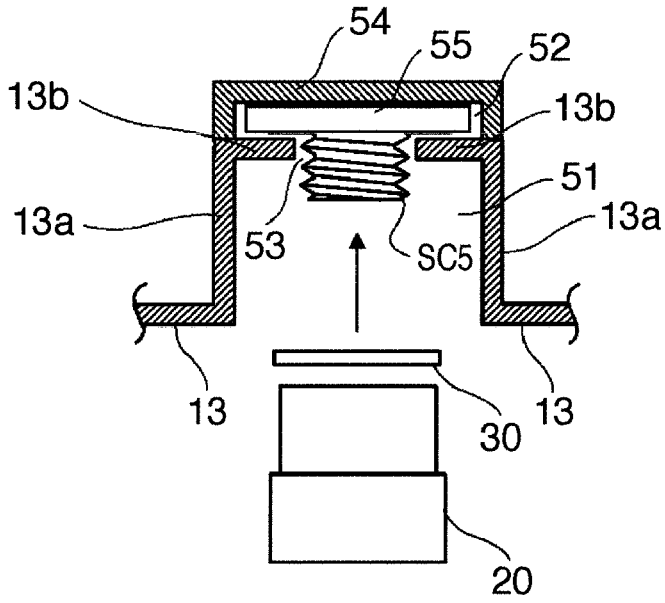
FIG. 6B is a sectional view taken along a line X-X in FIG. 6A.

FIG. 6A is a sectional view of a golf club head D according to still another embodiment of the present invention, taken long the same plane as in the sectional view of FIG. 2. FIG. 6B is a sectional view taken along a line X-X in FIG. 6A, and shows a state in which a weight member 20 is detached. The same components as in the golf club head A of the above-described first embodiment are denoted by the same reference numerals below, and a description thereof will not be repeated. Only components different from those of the golf club head A will be described.

A rail portion 50 extending along the above-described line L1 is formed in a sole portion 13 of a head body 10 of the golf club head D. The rail portion 50 guides the weight member 20 to move in the direction of an arrow D2, as will be described below. The arrow D2 indicates the same direction as the straight line L1.

The rail portion 50 includes a groove 51 formed by recessing the sole portion 13 and open at its lower part, and a partitioned chamber 52 formed in the upper portion of the groove 51. Both the groove 51 and partitioned chamber 52 are formed along the above-described straight line L1.

The groove 51 has a pair of side walls 13*a* and a pair of partitioning portions 13*b* formed by bending the side walls 13*a*. The partitioning portions 13*b* are located between the groove 51 and partitioned chamber 52, thereby vertically partitioning them. The pair of the partitioning portions 13*b* are spaced apart from each other to form a slit 53. The groove 51 accommodates the weight member 20. The depth of the groove 51 is set such that the lowest portion of the weight member 20 fixed to the head body 10 is positioned above the lowest portion of the sole portion 13. With this arrangement, the weight member 20 does not project from the sole portion 13, and therefore it is possible to prevent the weight member 20 from catching the ground upon hitting a ball.

The partitioned chamber 52 is formed by joining the lower ends of a lid member 54 having a U-shaped cross section to the partitioning portions 13*b*. The upper part of the partitioned chamber 52 is closed by the lid member 54.

The partitioned chamber 52 accommodates a slide member 55. The slide member 55 is sized such that it cannot rotate in the partitioned chamber 52 and, for example, has a square shape when viewed from the above. An axial male screw portion SC5 that passes the slit 53 is integrally connected to the slide member 55. A female screw hole SC6 which threadably engages with the male screw portion SC5 is formed in the weight member 20. The width of the weight member 20 is larger than that of the slit 53 in the lateral direction.

A back-side part of a side portion 14 forms an opening, and a closing member 141 is fixed thereto. Upon assembling the head body 10, after the slide member 55 is inserted into the partitioned chamber 52 from the above-described opening, the closing member 141 is secured to the head body 10 to close the opening. The closing member 141 has a wall portion 141*a* to close the back-side end portion of the rail portion 50. The closing member 141 may be detachable from the head body 10. In this case, it becomes possible to exchange the slide member 55. The end portion of the rail portion 50 on a face portion 11 side is closed by a wall portion 16, which is formed by bending a part of the head body 10, and a part of the lid member 54.

In the golf club head D with the above-described components, when the male screw portion SC5 threadably engages with the female screw hole SC6, the slide member 55 and weight member 20 sandwich the partitioning portions 13*b*, thereby fixing the weight member 20 to the head body 10. A washer 30 inserted between the partitioning portions 13*b* and weight member 20 prevents the loose threadable engagement between the male screw portion SC5 and female screw hole SC6.

When changing the position of the weight member 20, the threadable engagement between the male screw portion SC5 and female screw hole SC6 is loosened, and the slide member 55 and weight member 20 are moved in the direction of the arrow D2. Since these members are guided by the rail portion 50 during movement, their positions can be easily changed. By threadably engaging the male screw portion SC5 with the female screw hole SC6 at a desired position, the weight member 20 can be fixed.

As described above, in this embodiment, the weight member 20 can be fixed at a given position on the straight line L1, and therefore it is possible to more finely adjust the center-of-gravity position and center-of-gravity depth of the golf club head D. Note that in this embodiment, the center-of-gravity position of the head body 10 is defined as a center-of-gravity position CG of the head body 10 without the weight member 20 and slide member 55. Also, in this embodiment, since the weight member 20 can be completely detached from the slide member 55, one of a plurality of the weight members 20 having different weights may be selectively fixed to the head body 10.

In this embodiment, since the rail portion 50 is enclosed by the wall portions 141*a* and 16 and lid member 54, it is possible to prevent dust and the like from entering the head body 10 through the rail portion 50.

Note that the structure of the rail portion 50 is not limited to that shown in FIGS. 6A and 6B, and any structure can be used as long as the weight member 20 can be moved and fixed at a given position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-241654, filed Sep. 19, 2008, which is hereby incorporated by reference herein in its entirety.

What is claimed is:

1. A hollow golf club head comprising:

a hollow head body;

a weight member attached to a sole portion said head body; and fixing means for fixing said weight member at any one of a plurality of attachment positions of said sole portion so that a golfer can change a position of said weight member, wherein the plurality of attachment positions are located on a straight line included in a plane, the plane includes a center-of-gravity position of said head body without said weight member attached thereto and is perpendicular to a toe-and-heel direction of said head body, said head further comprises a rail portion which is formed along the straight line in said sole portion of said head body and defines the plurality of attachment positions, said fixing means fixes said weight member at a given position on said rail portion, said head body comprises an opening in a back-side part thereof, and a closing member closing the opening, and said closing member comprises a wall portion to close a back-side end portion to the rail portion.

2. The head according to claim 1, wherein said closing member is detachably attached to the opening.

* * * * *